US005482470A

United States Patent [19]

Atsumi et al.

[11] Patent Number: 5,482,470

[45] Date of Patent: Jan. 9, 1996

[54] ELECTRICAL CONNECTOR

[75] Inventors: Keigo Atsumi; Eiji Saijo, both of Yokkaichi, Japan

[73] Assignee: Sumitomo Wiring Systems, Ltd., Japan

[21] Appl. No.: 426,141

[22] Filed: Apr. 19, 1995

Related U.S. Application Data

[63] Continuation of Ser. No. 243,985, May 17, 1994, abandoned.

[30] Foreign Application Priority Data

May 20, 1993 [JP] Japan ..... 5-142988
May 20, 1993 [JP] Japan ..... 5-142989

[51] Int. Cl.[6] ..... H01R 13/629

[52] U.S. Cl. ..... 439/246; 439/271; 439/79

[58] Field of Search ..... 439/246, 274, 439/275, 271, 78, 79, 252

[56] References Cited

U.S. PATENT DOCUMENTS 3,864,000 2/1975 Coller et al. ..... 439/246
4,865,558 9/1989 Stoner ..... 439/271
4,923,405 5/1990 Munsterman et al. ..... 439/78

FOREIGN PATENT DOCUMENTS 30141 9/1970 Japan ..... 439/246
3272580 12/1991 Japan ..... 439/79

*Primary Examiner*—Gary F. Paumen
*Attorney, Agent, or Firm*—Jordan B. Bierman; Bierman and Muserlian

[57] ABSTRACT

This invention prevents terminals 4 and 5 from being abraded or ground at contacting portions due to vibrations. An end of a male terminal 5 is secured in a part of a stepped hole 16 in a rear wall portion 12 and the other end off the terminal 5 18 coupled to a female terminal 4. Even if the female terminal 4 is displaced due to vibrations in a coupled position relative to the male terminal 5, the male terminal 5 can elastically deflect in another part of the stepped hole 16 in accordance with a displacement of the female terminal 4. Consequently, an abnormal contacting pressure caused by vibration at contacting portions of the male and female terminals 5 and 4 can be absorbed to reduce wear or abrasion between them.

2 Claims, 6 Drawing Sheets

ELECTRICAL CONNECTOR

This application is a continuation, of application Ser. No. 08/243,985, filed May 17, 1994, now abandoned.

This application claims the benefit of priority U.S. application Ser. No. 243,985, filed May, 17, 1994, now abandoned, which, in turn, claims the priority of Japanese Applications 142988/1993, filed May 20, 1993 and 142989/1993, filed May 20, 1993.

BACKGROUND OF THE INVENTION

1. Field of the Invention

This invention relates to an electrical connector and more particularly to an electrical connector which secures a male terminal to a male connector housing.

2. Statement of the Prior Art

For convenience of explanation, a construction of a prior electrical connector will be explained by referring to FIG. 12. FIG. 12 Is a longitudinal sectional view of the prior electrical connector.

Heretofore, an electrical connector having a male connector housing 1 in which male terminals 5 are secured by an insert molding or a pressingly insertion is known as a connector for directly connecting devices or a connector For a printed circuit board. The conventional male connector housing 1, as shown in FIG. 12, supports the male terminal 5 with its rear end being directly attached to a printed circuit board B and its front end passing through and being fixed in a rear wall 12 of the housing 1. The male terminal 5 is adapted to be coupled to a female terminal 4 mounted in a female connector housing 2. The housing 1 is provided on its lower portion with a support base 19 which serves to horizontally support the housing 1 on the board B.

However, as shown exaggeratedly in FIG. 12, in the case that such type of the electrical connector is used For a wiring in a motive vehicle, vibrations in the motive vehicle are transferred to the female terminal 4 through a cable W. Then, misalignment of axes of the male and female terminals 5 and 4 causes a friction in a contacting portion of them, thereby wearing or abrading the contacting portion. Consequently, both terminals will be brought into a bad contacting state during long term use.

SUMMARY OF THE INVENTION

An object of the present invention is to provide an electrical connector which can maintain a good contacting state In a contacting portion of mane and female terminals for a long term.

In order to achieve the above object, an electrical connector of the present invention comprises:

a female connector housing; female terminals adapted to be received in the female connector housing; a male connector housing having a front hood portion and a rear wall portion provided with stepped holes; and male terminals attached to the male connector housing through the stepped holes. The front hood portion is adapted to receive the female connector housing. Each of the stepped holes having a reduced diameter part at an outer side of the rear wall and an enlarged diameter part at an inner side of the rear wall. Each of said male terminals being secured in the reduced diameter part and passing through the enlarged diameter part with a given clearance. The male terminals are coupled to the female terminals when said female connector housing is inserted into the hood portion of the male connector housing.

An elastic member may be inserted into the enlarged diameter part of the stepped hole to elastically support the male terminal in the enlarged diameter part. The elastic member may be inserted into the stepped hole to elastically support the male terminal therein.

According to the present invention, when the female connector housing is coupled to the male connector housing the male terminals are connected to the female terminals, respectively. At this time, the male terminal is secured in the reduced diameter part of the stepped hole at its one end and supported in the female terminal at its other end. An intermediate portion of the male terminal between the reduced diameter part and the female terminal is supported in the enlarged diameter part with a given clearance.

In this coupled position, even if the female terminal is displaced due to vibrations, the male terminal can elastically deflect In the enlarged part of the stepped hole in accordance with a displacement of the female terminal. Consequently, an abnormal contacting pressure caused by vibrations at contacting portions of the male and Female terminals can be absorbed to reduce wear or abrasion between them.

According to another aspect of the present invention, one end of the male terminal is elastically supported through the elastic member in the stepped hole and the other end of the male terminal is supported in the female terminal. In this coupled position, even if the female terminal is displaced due to vibrations, the elastic member deflects so that the male terminal is displaced in the stepped hole. Consequently, the male terminal is elastically displaced in accordance with the displacement of the female terminal. An abnormal contacting pressure caused by vibrations at contacting portions of the male and female terminals can be absorbed to reduce wear or abrasion between them.

In the electrical connector of the present invention, it is possible to maintain a good contacting state of the terminals for a long term by supporting the male terminal in the reduced diameter part of the stepped hole.

Also, it is possible to maintain a good contacting state of the terminal for a long term by elastically supporting the male terminal through the elastic member in the stepped hole.

DETAILED DESCRIPTION OF THE PREFERRED EMBODIMENTS

Embodiments of an electrical connector in accordance with the present invention will be explained below by referring now to FIGS. 1 to 11..

<Example 1>

Figure 1:
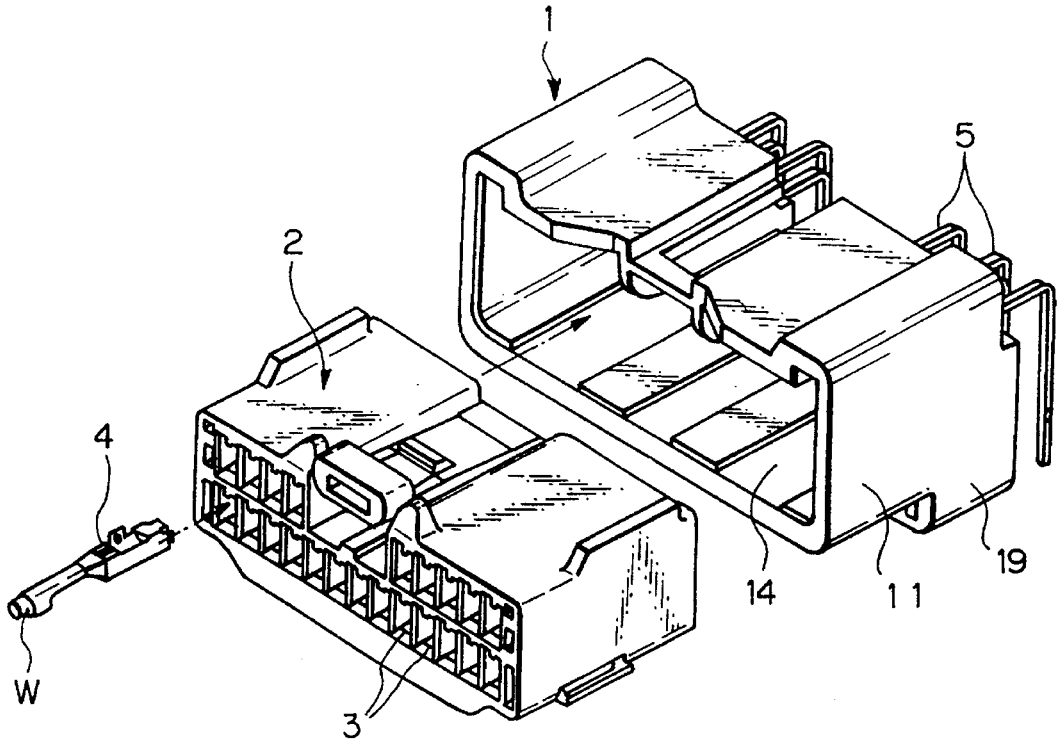
FIG. 1 is an exploded perspective view of an embodiment of an electrical connector in accordance with the present invention.
Figure 2:
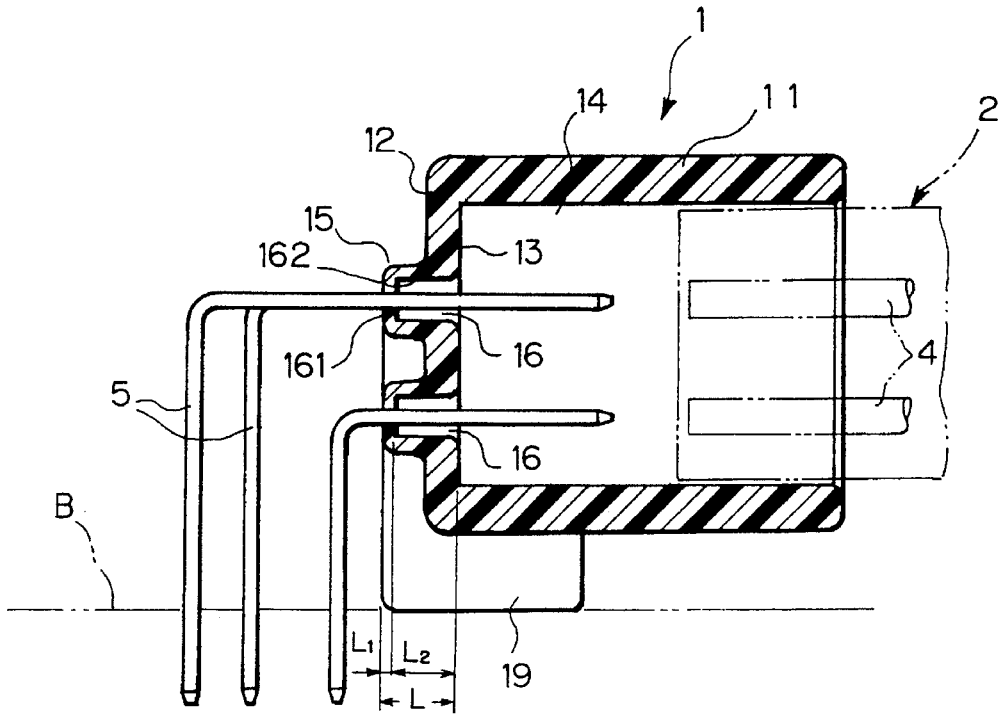
FIG. 2 is a longitudinal sectional view of a first embodiment of a male connector housing.
Figure 3:
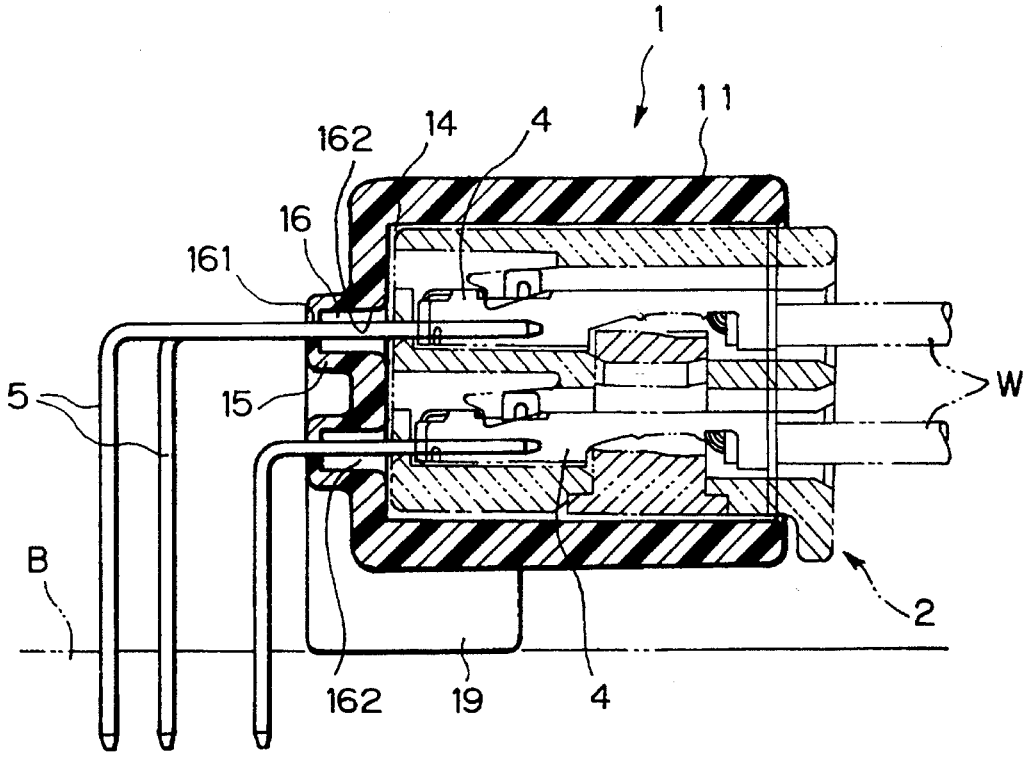
FIG. 3 is a longitudinal sectional view of the connector, illustrating exaggeratedly a coupled position of male and female connector housings in the first embodiment.

A first embodiment of the electrical connector of the present invention, which is mounted on a printed circuit board, is described by referring to FIGS. 1 to 3.

As shown in FIG. 1, in the electrical connector, a female connector housing 2 is adapted to be received in a male connector housing a female terminal 4 attached to a distal end of an electrical cable W is adapted to be inserted into one of terminal accommodating holes 8 in the female connector housing 2. The female terminal 4 is made by a conventional manner of bending a metal sheet into a box like body, into which a plate like male terminal 5 can be inserted.

The male connector housing 1, as shown in FIG. 2, is formed into a front side open box having a front hood portion 11 and a rear wall portion 12. A rectangular coupling space 14 is defined by the interior of the front hood portion 11 and an Inner face 13 of the rear wall portion 12. The rear wall portion 12 Is provided on an outer face with bosses 15. A cylindrical stepped hole 16 extends through each boss 15 and the rear wall portion 12 and has a depth (length) L. The stepped hole 16 includes a reduced diameter part 161 (length L1) at an outer side of the boss 15 and an enlarged diameter part 162 (length L2) at an inner side of the rear wall portion 12. A middle portion of the male terminal 5 is secured in the reduced diameter part 161 by an insert molding. A distal end of the male terminal 5 projects through the enlarged diameter portion 162 into the coupling space 14 by a length required for being coupled to the female terminal 4. That is, the mane terminal 5 is secured in the reduced diameter part 161, passes through the enlarged part 162 with a given clearance, and extends toward the coupling space 14.

The hood portion 11 is provided on its rear side with a support base 19 which serves to support the male connector housing 1 on the printed circuit board B horizontally. The male terminal 5 is made of a thin conductive metal plate and bent downwardly by an angle of 90° at a rear side from the boss 15. A lower end of the terminal 5 is inserted into and secured in the printed circuit board B shown by a two dot chain line in FIG. 2.

When the female connector housing 2 is coupled into the coupling space 14 in the male connector housing 1, as shown in FIG. 3, the male terminal 5 is coupled into the female terminal 4. Then, the middle portion of the male terminal 5 is secured in the reduced diameter part 161 of the stepped hole 16 through the length L1 while the other end of the male terminal 5 passes through the enlarged diameter part 162 of the hole 16 with a given clearance along the distance L2 and enters into the female terminal 4 to be secured therein. In this coupled position, when the female connector housing 2 is inclined upwardly in the coupling space 14 in the male connector housing 1 due to vibrations, the male terminal 5 is elastically deflected at a portion corresponding to the length L2 in accordance with a displacement of the female terminal 4, as shown exaggeratedly in FIG. 3, thereby absorbing an abnormal contacting pressure at a contacting portion of the male and female terminals 5 and 4 on account off the vibrations. This results in relief of wear or abrasion. Although it is not illustrated in the drawing, in the case that the female terminal 4 is displaced upwardly or downwardly in the female connector housing 2, the same effect can be obtained.

<Example 2>

Figure 4:
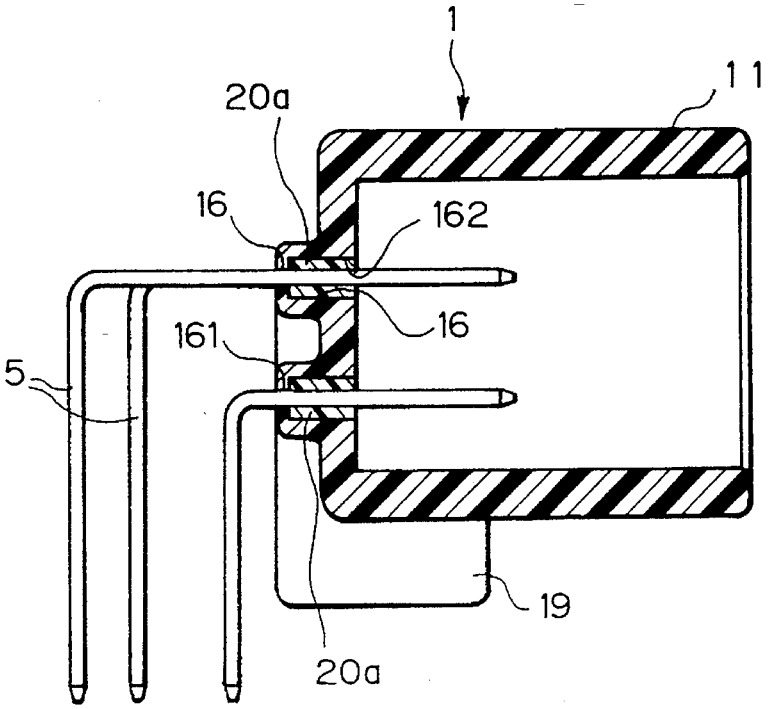
FIG. 4 is a longitudinal sectional view of a second embodiment of the male connector housing.

A second embodiment is substantially the same as the first embodiment. As shown in FIG. 4, a difference between them is to dispose an elastic member **20*a* made of an elastic rubber in the enlarged diameter part 162 of the stepped hole 16. Thus, in the second embodiment, since the male terminal 5 is elastically supported by the elastic member 20*a* even if any external force is applied to a distal end of the male terminal 5 before the female connector housing 2 is coupled into the coupling space 14 in the male connector housing 1, the male terminal is not deformed eternally. Also, since the male terminal 5 is elastically supported in the enlarged diameter part 162, it is not necessary to extend the length L2 of the reduced diameter part 161 in the boss 15, it is possible to hold a plurality of male terminals 5 straightly toward an inserting direction of the female connector housing 2, it is not necessary to make the male connector housing 2 a large size, and it is possible to readily insert the female connector housing 2 into the male connector housing 1**.

<Example 3>

Figure 5:
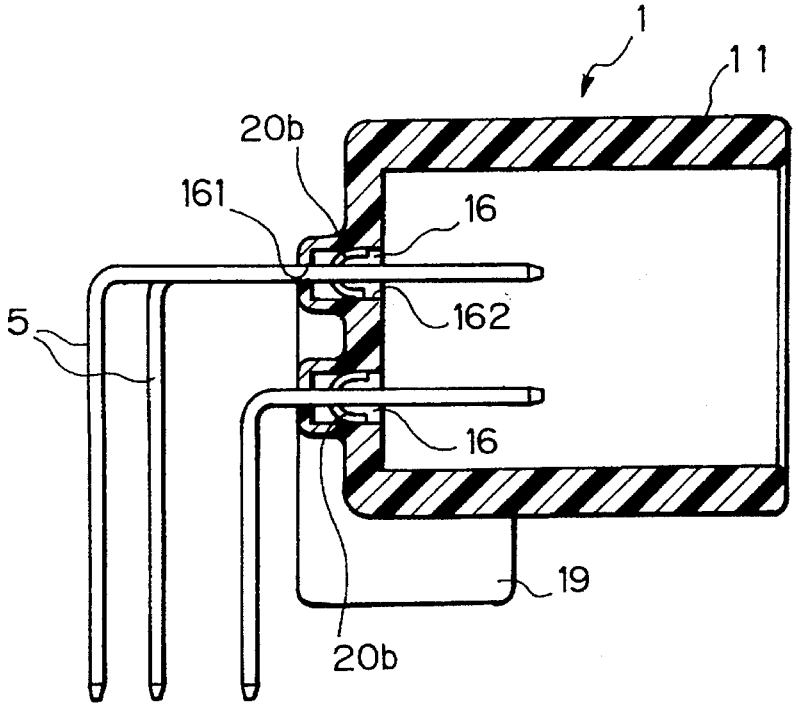
FIG. 5 is a longitudinal sectional view of a third embodiment of the male connector housing.

A third embodiment is substantially the same as the first embodiment. As shown in FIG. 5, a difference between them is to mount a spring **20*b* on the male terminal 5 and to dispose the spring 20*b* in the enlarged diameter part 162 of the stepped hole 16. Thus, in the third embodiment, it is possible to prevent an eternal deformation of the male terminal 5, to hold it straightly, and to smooth by insert the female connector housing 2 into the male connector housing 1**, by the same manner as the second embodiment.

<Example 4>

Figure 6:
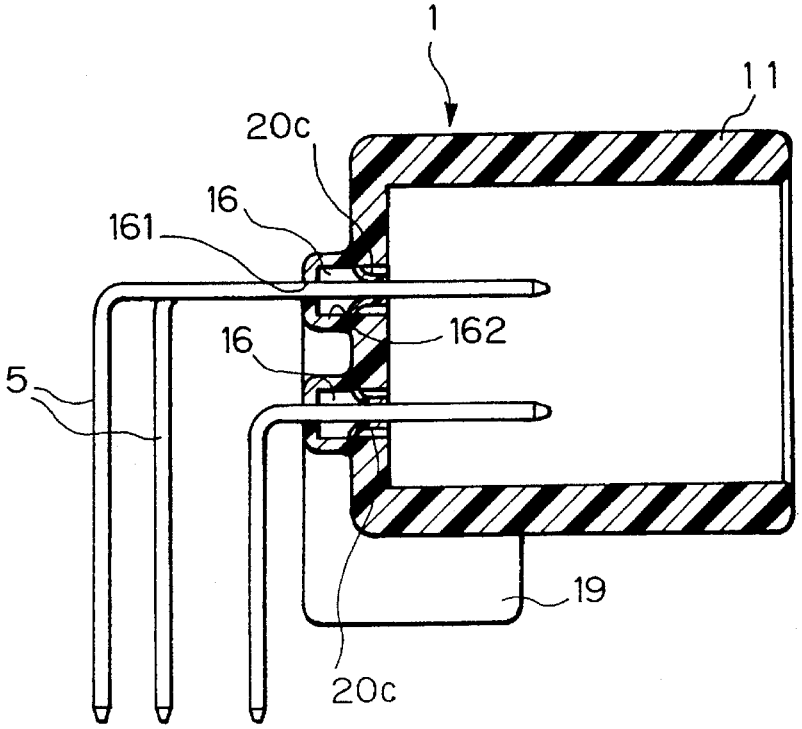
FIG. 6 is a longitudinal sectional view of a fourth embodiment of the male connector housing.

A fourth embodiment is substantially the same as the first embodiment. As shown in FIG. 6, a difference between them is to provide an elastic piece **20*c*, which projects toward the coupling space 14, in the enlarged diameter part 162 of the stepped hole 16 and to elastically support the male terminal. 5 in the part 162 by means of the piece 20*c*. Thus, in the fourth embodiment, it is possible to prevent an eternal deformation of the male terminal 5, to hold it straightly, and to smoothly insert the female connector housing 2 into the male connector housing 1**, by the same manner as the second embodiment.

<Example 5>

Figure 7:
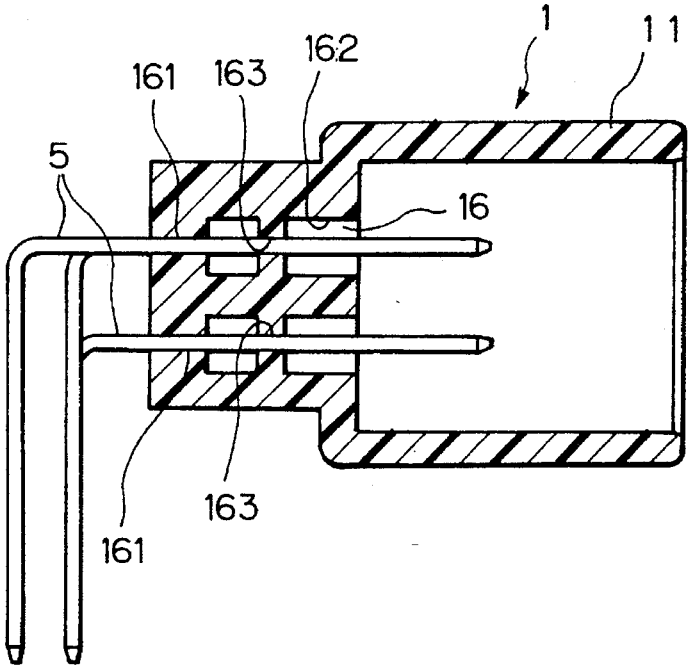
FIG. 7 is a longitudinal sectional view of a fifth embodiment of the male connector housing.
Figure 8:
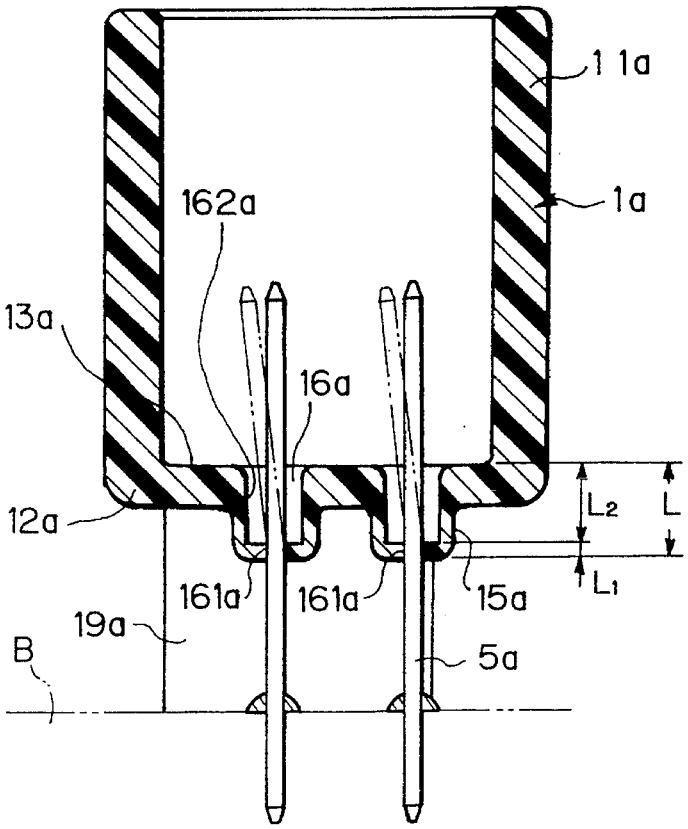
FIG. 8 is a longitudinal sectional view of a sixth embodiment of the male connector housing.

As shown in FIG. 7, in a fifth embodiment, the enlarged diameter part 162 of the stepped hole 16 is provided with a second reduced part 163 whicprojecting from opposite sides of a rear wall portion **12*a* support a male connector housing la on the printed circuit board B vertically. A male terminal 5*a* made of a thin metal plate projects straightly downwardly from a boss 15*a* and a lower end of the male terminal 5*a* is inserted into and soldered in an aperture in the printed circuit board B to fix the connector housing la on the board B vertically. By the same manner as the first embodiment, a cylindrical stepped hole 16***a* is formed in each boss 15*a* and the rear wall portion 12*a* and has a depth (length) L. The stepped hole 16*a* includes a reduced diameter part 161*a* having a depth (length) L1 at an outer side of the boss 15*a* and an enlarged diameter part 182*a* having a depth (length) L2 at an inner side of the rear wall portion 12*a*. The male terminal 5*a* is secured in the reduced diameter part 181*a* by an insert molding and passes through the enlarged diameter part 162*a* with a given clearance.

In the sixth embodiment, by the same manner as the first embodiment, when the male terminal 5*a* is coupled into a female terminal not shown, a middle portion of the male terminal 5*a* is secured in the reduced diameter part 181*a* and a distal end of the terminal 5*a* is coupled into and supported in the female terminal through the distance L2 in the enlarged diameter part 162*a*. As shown exaggeratedly in FIG. 8, the male terminal. 5*a* is elastically deflected at the portion of the length L2 to release an abnormal contacting pressure on account of the vibrations onto the male terminal 5*a*. Although the reduced diameter part 161*a* secures the male terminal 5*a* in the sixth embodiment, an elastic member may be disposed in the enlarged diameter part 162*a* by the same manner as the second through Fifth embodiments.

Although the male terminal 5 or 5*a* is secured in the reduced diameter part 161nal. 5*a* is elastically deflected at the portion of the length L2 to release an abnormal contacting pressure on account of the vibrations onto the male terminal 5*a*. Although the reduced diameter part 161*a* secures the male terminal 5*a* in the sixth embodiment, an elastic member may be disposed in the enlarged diameter part 162*a* by the same manner as the second through Fifth embodiments.

Although the male terminal 5 or 5*a* is secured in the reduced diameter part 161 or 161*a* by the insert molding in the first through sixth embodiments, the terminal may be secured in the part by pressingly fitting. It will be preferable to utilize any one of the second to fifth embodiments in order to direct the distal end of the male terminal 5 to the inserting direction of the female connector housing 2 when pressingly inserting the male Terminal 5 into the reduced diameter part 161.

Although the bosses 15 or 15*a* are provided on the outer side of the rear wall portion 12 or 12*a* and the reduced diameter part 161 or 161*a* is formed in the boss 15 or 15*a* in the first through sixth embodiments, the rear wall portion 12 or 12*a* may be formed into a thick wall so that the stepped hole 16 or 16*a* is formed In the wall.

<Example 7>

Figure 9:
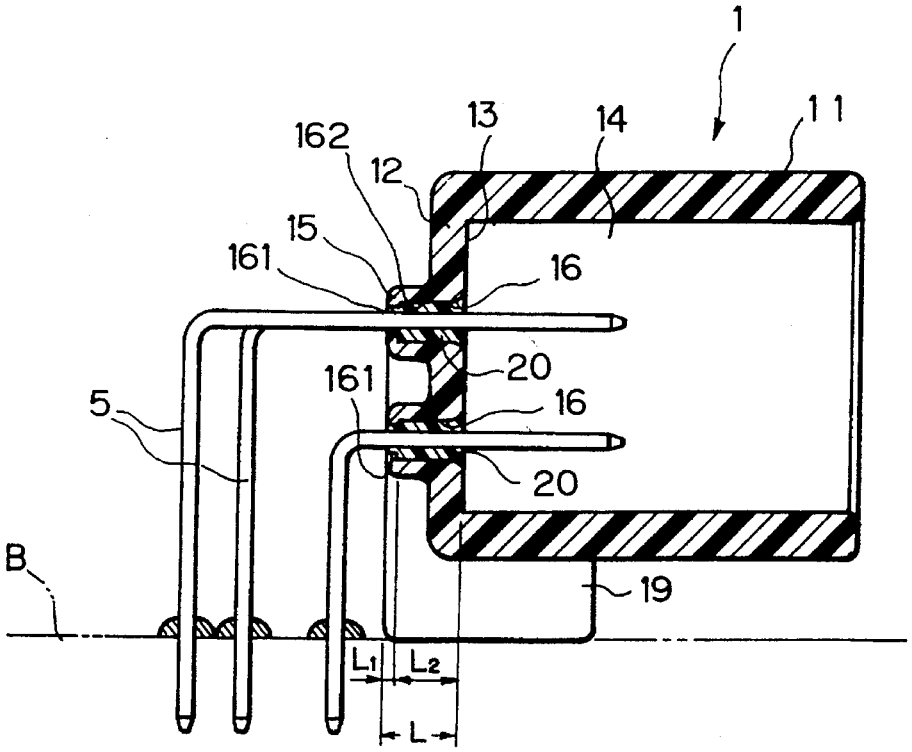
FIG. 9 is a longitudinal sectional view of a seventh embodiment of the male connector housing.

A male connector housing 1 in a seventh embodiment, as shown in FIG. 9, includes a rectangular hood portion 11 adapted to receive a female connector housing 2 and a rear wall portion 12 integrally formed on a rear side of the hood portion 11. A rectangular coupling space 14 is defined by the interior of the hood portion 11 and an inner face of the rear wall portion 12. The rear wall portion 12 is provided on an outer face with a boss 15 projecting backwardly to define a thickness L. A stepped hole 16 extends from the Inner face 13 of the rear wall portion 12 to the outer Face of the boss 15. The stepped hole 16 Includes a reduced diameter part 161 having a depth (length) L1 at an outer side of the boss 15 and an enlarged diameter part 162 having a depth (length) L2 at an inner side of the rear wall portion 12. An elastic member 20*d* such as a rubber ring is inserted in the stepped hole 16. A male terminal 5 passes axially through the elastic member 20*d* and projects straightly in a coupling direction in the coupling space 14 and a distal end of the male terminal 5 extends by a length enough to enter into a female terminal 4. That is, the male terminal 5 is elastically supported by secured in the stepped hole 16 through a distance L and projects into the coupling space 14.

The hood portion 11 is provided on its rear side with a support base 19 which serves to support the male connector housing 1 on the printed circuit board B horizontally. The male terminal 5 is made of a thin conductive metal plate and bent downwardly by an angle of 90° at a rear side from the boss 15. A lower end of the terminal 5 is inserted into and soldered In an aperture in the printed circuit board B shown by a two dot chain line in FIG. 9.

Figure 10:
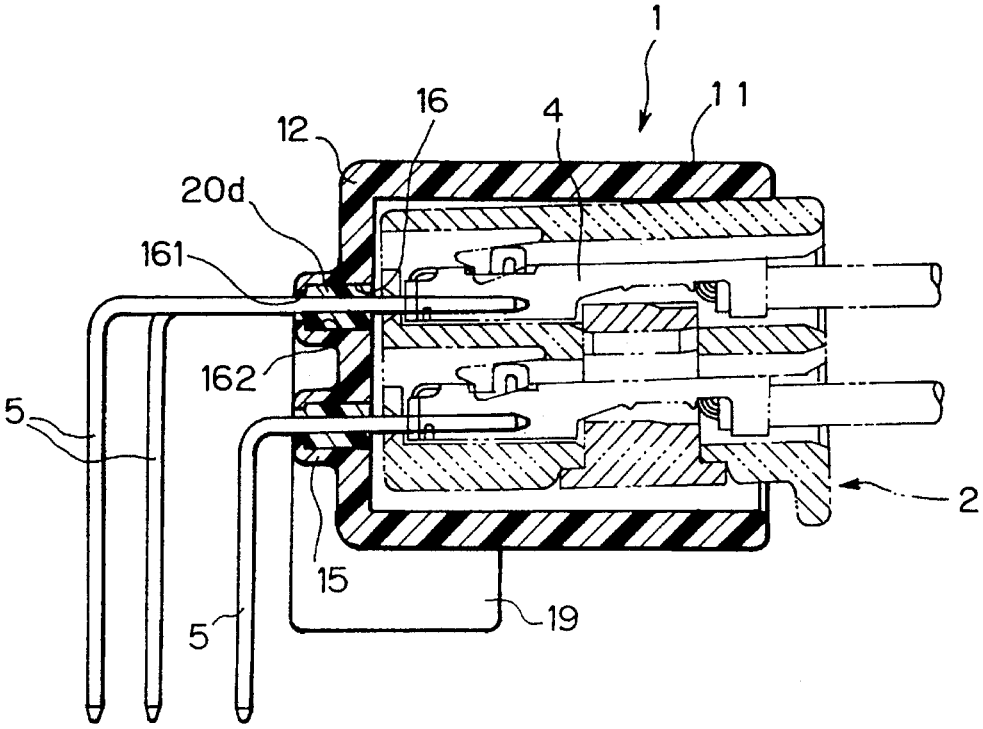
FIG. 10 is a longitudinal sectional view of the connector, illustrating exaggeratedly a coupled position of male and female connector housing in the seventh embodiment.

When the female connector housing 2 is being coupled into the coupling space 14 in the male connector housing 1 in the seventh embodiment, as shown in FIG. 10, the male terminal 5 pushes the female terminal 4. The reduced diameter part 161 holds the male terminal 5 through the elastic member 20*d* not to be pushed back by the female terminal 4. Then, the male terminal 5 is coupled to the female terminal 4. At this time, the male terminal 5 is elastically secured by the elastic member 20*d* in the stepped hole 16 through the thickness L and clamped at its other end in the female terminal 4.

In this coupled position, when the female connector housing 2 is inclined upwardly in the coupling space 14 in the male connector housing 1 due to vibrations, the male terminal 5 along with the elastic member 20*d* are elastically deformed upwardly, as shown exaggeratedly in FIG. 10. Particularly, in this embodiment, the male terminal 5 is elastically deformed at a portion of the length L in accordance with a displacement of the female terminal 4, thereby absorbing an abnormal contacting pressure at a contacting portion of the male and female terminals. This results in relief of wear or abrasion. Although it is not illustrated in the drawing, in the case that the female terminal 4 is displaced upwardly or downwardly in the female connector housing 2, the same effect can be obtained.

In the seventh embodiment, the boss 15 is provided on the outer face of the rear wall portion 12 and the stepped hole is formed through the boss 15 and rear wall portion. The boss is may be removed and the rear wall portion 12 may be formed into a wall with a thickness L enough to hold the male terminal 5 straightly in the inserting direction of the female coupling housing 2 in the coupling space 14.

<Example 8>

Figure 11:
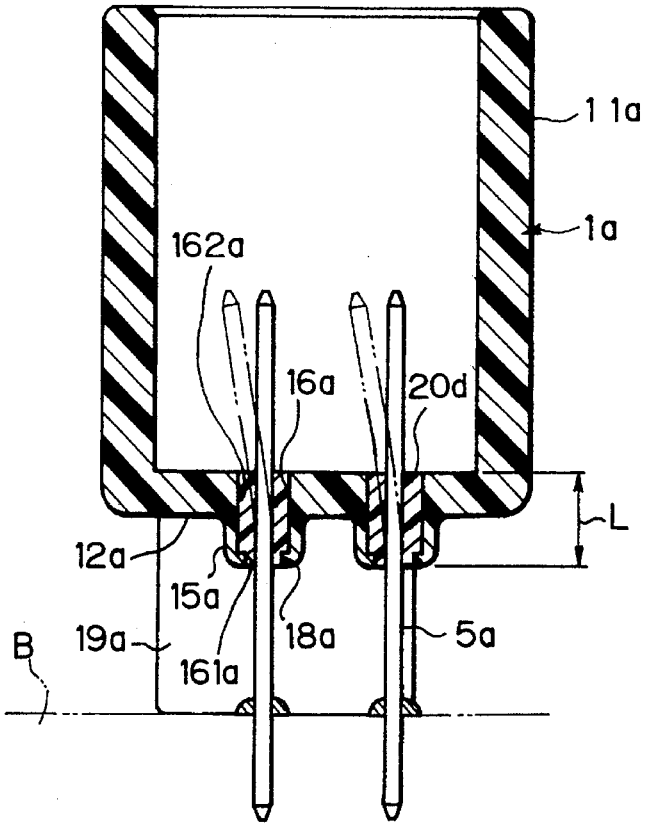
FIG. 11 is a longitudinal sectional view of an eighth embodiment of the male connector housing.
Figure 12:
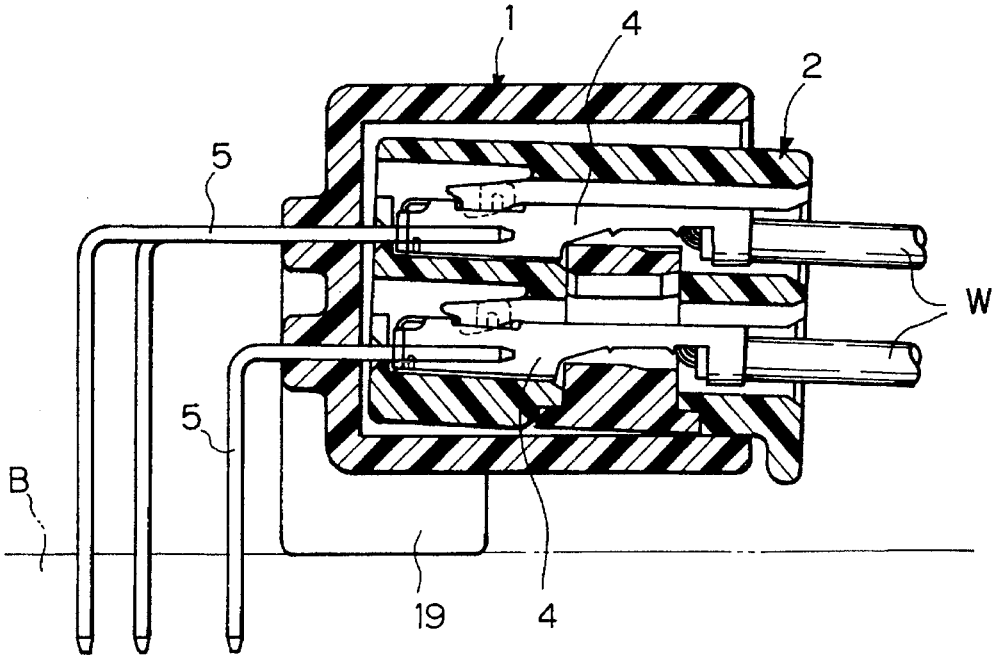
Fig. 12 PRIOR ART
FIG. 12 is a longitudinal sectional view of a prior electrical connector, illustrating exaggeratedly a coupled position of male and female connector housings.

An eighth embodiment shown in FIG. 11 is a vertical type of an electrical connector. In the vertical type of the electrical connector, a pair of support bases 19*a* projecting from opposite sides of a rear wall portion 12*a* support a male connector housing la on the printed circuit board B vertically. A male terminal 5*a* made of a thin metal plate projects straightly downwardly from a boss 15*a* and a lower end of the male terminal 5*a* is inserted into and soldered in an aperture In the printed circuit board B to fix the male connector housing la on the board B vertically.

In this vertical type, since the male terminal 5*a* is substantially supported in the reduced diameter part 161*a* and elastically supported by the elastic member 20*d* through the thickness L, the male terminal. 5*a* can be elastically deflected as shown by two dot chain lines in FIG. 11 thereby releasing an abnormal contacting pressure due to vibrations at the contacting portion of the male and female terminals.

What is claimed is:

1. An electrical connector comprising a female housing adapted to receive a plurality of female terminals, a male housing having a front hood and a rear wall, said front hood facing, and adapted to receive, said female housing, said rear wall having a plurality of stepped holes, said holes being provided with reduced diameter portions and enlarged diameter portions inward of said reduced portions, elastic members in said stepped holes and having bores therethrough, male terminals attached to said male housing by said reduced portions and extending through said bores, whereby said male terminals are elastically supported by said elastic members, said male terminals adapted to contact said female terminals where said female housing is in said front hood.

2. The electrical connector of claim 4 wherein said elastic members are in said enlarged portions.

* * * * *